United States Patent [19]

Hillock

[11] Patent Number: 4,927,143

[45] Date of Patent: May 22, 1990

[54] FLUID VIBRATION DAMPER FOR RACQUET

[76] Inventor: Bart A. Hillock, 5560 Pembroke, Santa Barbara, Calif. 93111

[21] Appl. No.: 222,282

[22] Filed: Jul. 22, 1988

Related U.S. Application Data

[63] Continuation of Ser. No. 911,005, Sep. 24, 1986, abandoned.

[51] Int. Cl.[5] ..... A63B 51/10

[52] U.S. Cl. ..... 273/73 D

[58] Field of Search ..... 273/73 R, 73 C, 73 D, 273/67 R, 170; 124/23, 24, 80; 464/180

[56] References Cited

U.S. PATENT DOCUMENTS

| | | | |
|---|---|---|---|
| 2,737,216 | 3/1956 | Kenerson . | |
| 3,874,666 | 4/1975 | Ross . | |
| 4,057,250 | 11/1977 | Kuban . | |
| 4,182,512 | 1/1980 | Kuebler | 273/73 C |
| 4,364,564 | 12/1982 | Lewis . | |
| 4,512,576 | 4/1985 | Dahlgren . | |
| 4,609,194 | 9/1986 | Krent et al. | 273/73 D |
| 4,761,007 | 8/1988 | Boschian | 273/73 D |

FOREIGN PATENT DOCUMENTS

| | | | |
|---|---|---|---|
| 225938 | 12/1959 | Australia | 273/170 |
| 0171033 | 2/1986 | European Pat. Off. | 273/73 R |
| 3443009 | 5/1986 | Fed. Rep. of Germany | 273/73 D |
| 3504137 | 8/1986 | Fed. Rep. of Germany | 273/73 D |
| 1398833 | 4/1965 | France | 273/73 D |

*Primary Examiner*—Edward M. Coven
*Assistant Examiner*—William E. Stoll
*Attorney, Agent, or Firm*—Foley & Lardner, Schwartz, Jeffery, Schwaab, Mack, Blumenthal & Evans

[57] ABSTRACT

The device comprises a body having a well which receives a damping fluid and a weight in the form of a lead or steel ball. The body has a groove which extends around the entire periphery of the body so as to receive the strings of a sports racquet. The groove and the well are oriented such that the well extends perpendicular to the plane of the racquet head when the groove entraps the strings of a racquet.

14 Claims, 2 Drawing Sheets

FLUID VIBRATION DAMPER FOR RACQUET

This application is a continuation, of application Ser. No. 911,005, filed Sept. 24, 1986, now abandoned.

BACKGROUND OF THE INVENTION

1. Field of the Invention

The present invention relates to sports racquets and especially to devices for attachment to such racquets for damping the rebound forces produced when the racquet is used.

2. Discussion of Related Art

Several devices have been suggested for reducing the vibration produced when one device, such as a tennis racquet, strikes another device, such as a tennis ball. For example, U.S. Pat. No. 4,512,576 to Dahlgren discloses a strung racket tension device which comprises two engageable parts. A first part is oblong and U-shaped in cross-section and is attached to one side of the strung surface of the racquet. The second part has a cross-section width that is smaller than the distance between the legs formed by the U-shaped first part. The second part is fitted between the legs of the first part and held in place through the use of a screw. The Dahlgren device is primarily for tensioning the strings of a racquet but also has a vibration damping effect on the racquet.

U.S. Pat. No. 4,364,564 discloses shock absorber for reducing the pschiological effects on the arm and shoulder of tennis players which comprises a hollow housing in which is disposed a predetermined amount of liquid of predetermined density and means for securing the liquid filled housing to the player's arm. The liquid is preferably liquid mercury.

U.S. Pat. No. 4,057,250 to Kuban discloses a sports racquet which includes a housing containing a weight. The housing is attached to the handle of the racquet near the bow or head the weight in the housing is preferably lead shot.

U.S. Pat. No. 2,737,216 to Kenerson discloses a recoilless hammer head construction. The device includes a hollow hammer head filled with a moving mass in the form of lead shot.

U.S. Pat. No. 3,874,666 to Ross discloses a tennis racquet having a ball retrieval means attached to the strings of the racquet. The ball retrieval means includes a hooked patch attached to the strings.

SUMMARY OF THE INVENTION

One object of the present invention is to provide a device which not only absorbs shock and vibration from the racket frame and strings and reduces the transmission to the player using a racquet incorporating the device but also to provide improved control of the racquet and a more solid feel when striking a ball.

A further object of the present invention is to provide a shock absorbing device which improves ball control when used on a tennis racquet by decreasing the normal trampoline effect produced when a ball hits the strings of a racquet. The ball suspended in the liquid helps provide this cushioning effect.

An even further object of the present invention is to provide a shock absorbing device which may be used on tennis racquets to make the racquet feel more solid.

In accordance with the above and other objects, the present invention is a device for reducing shock in sports racquets or the like when the racquet hits a ball. The device comprises a housing having a hollow interior space. The interior space is filled with a damping fluid containing a weight. The housing also includes an outer groove which is adapted to receive the strings of a racquet in order to hold the housing on the racquet.

In accordance with other aspects of the invention, the fluid may be a high viscosity fluid such as the oil used in automotive shock absorbers. In addition, the weight may be a steel ball.

In accordance with further aspects of the invention, the housing may be elongated in one direction and the groove may extend around the entire housing such as to form a rectangular abutment for the strings to rest against and such that the device will not rotate when attached to the strings.

The present invention also includes the vibration damping device in combination with a sports racquet with the vibration damping device attached to the strings of the racquet. Preferably, the vibration damping device is attached between the two cross strings nearest the throat of the racquet and between the two center main strings of the racquet.

BRIEF DESCRIPTION OF THE DRAWINGS

The above and other objects of the present invention will become more readily apparent as the invention is more fully described in the detailed description set forth below, reference being had to the accompanying drawings in which like reference numerals represent like parts throughout, and in which.

DETAILED DESCRIPTION OF THE PREFERRED EMBODIMENTS

Figure 1:
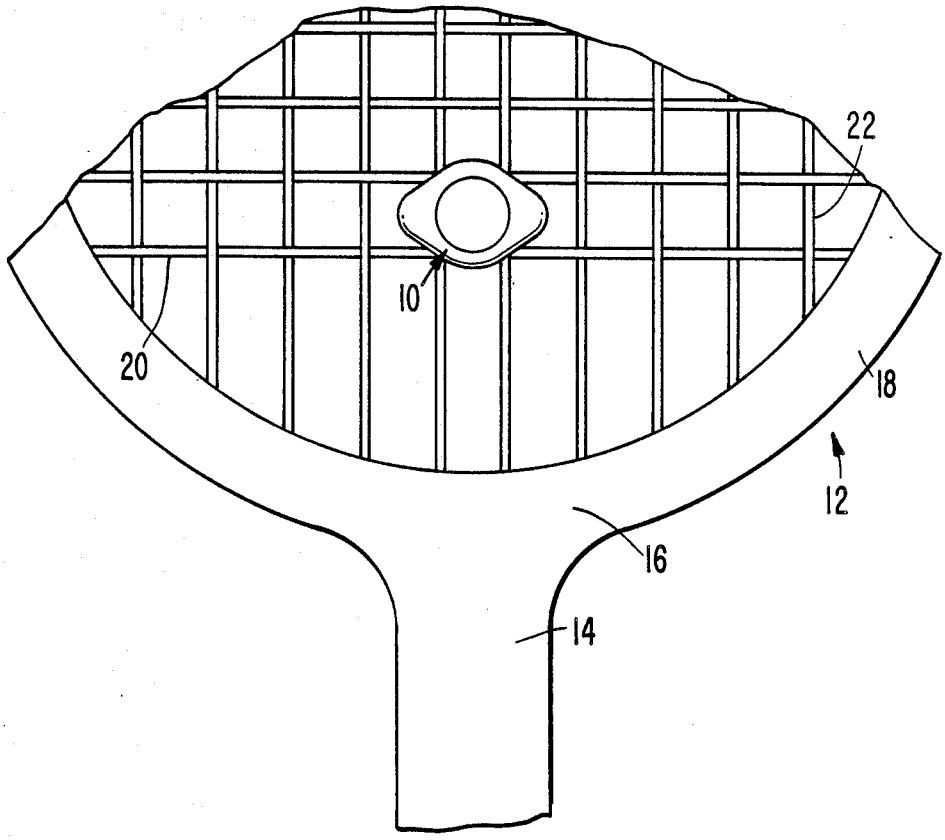
FIG. 1 shows the vibration damping device of the present invention attached to the strings of a tennis racquet.
Figure 2:
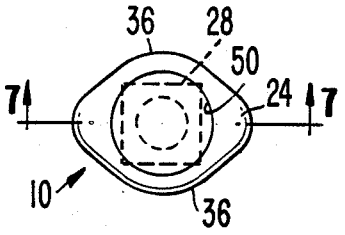
FIG. 2 is a top plan view of the vibration damping device of the present invention.
Figure 3:
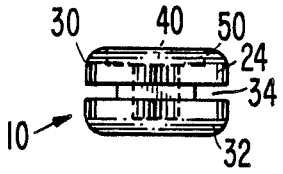
FIG. 3 is an end elevation view of the vibration damping device of the present invention.
Figure 4:
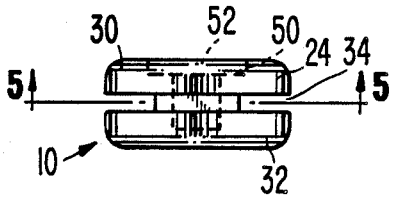
FIG. 4 is a side elevation view of the vibration damping device of the present invention.
Figure 5:
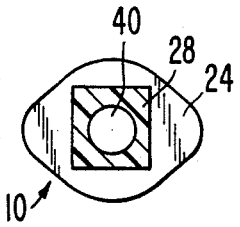
FIG. 5 is a top plan cross sectional view taken along line 5—5 of FIG. 4 showing the shape of the string receiving groove.
Figure 6:
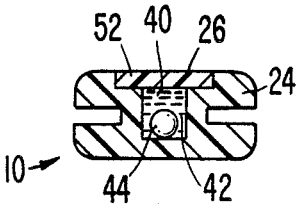
FIG. 6 is a side elevational view of the vibration damping device taken along line 6—6 of FIG. 1.

FIG. 1 shows the vibration damping device of the present invention attached to a conventional tennis racquet 12. The racquet 12 includes a handle 14, a throat 16, and a bow 18. There are strings threaded through the bow in a conventional manner to form cross strings 20 and longitudinal main strings 22. The device 10 is received between one pair of cross strings and one pair of longitudinal main strings. The device 10 is preferably attached close to the racquet throat and is received between the pair of cross strings closest to the racquet throat and the pair of longitudinal main strings in the center of the racquet. This has been found to be the optimum position for improving the "feel" of the racquet as well as increasing the accuracy of the racquet by increasing the sweet spot and reducing the vibration produced when the racquet hits a ball.

FIGS. 2 through 7 show a first embodiment of the present invention which includes a body 24 and a cover 26.

The body 24 includes a square shaped center portion 28 adjacent an upper portion 30 and a lower portion 32 which define a string receiving groove 34. Groove 34 extends around the entire periphery of the body so as to enable the body to become entrapped with the racquet strings and be physically turned after it has been entrapped. The size of the body may vary depending on the type of racquet being used. However, typical dimensions would include a center portion 28 of about 0.44 in. across each side. The top and bottom portions are elongated in one dimension and would typically be about 1 in. in this dimension, and about 0.76 in. in the smaller dimension. The smaller dimension of each of the top and bottom portions has a curved outer periphery 36 with a radius of about 0.38 in. The groove itself may have a width of about 0.06 in. while the thickness of the entire device is about 0.44 in. The primary consideration is that the groove 34 should be sufficiently deep to completely entrap the racquet strings without the need for clamps or the like.

In the center of the body a well 40 is formed to receive a damping fluid 42 and a damping weight in the form of a ball 44. The well may have a depth of about 0.34 in. with a diameter of about 0.25 in. and the ball 44 may have a diameter of about 0.12 in. This allows the ball 44 sufficient room to move from end to end in the well without being restricted by the walls of the well.

A round recess 50 is formed in the body 24 and is coaxial with the well 40. The recess 50 has a diameter of about 0.56 in., is about 0.06 in. deep and receives a round cover 52 which is slightly less than about 0.06 in. deep and has a diameter which is slightly less than 0.56 in. The cover 52 is glued into the recess 50 to hold the fluid 42 and the ball 44 within the well 40. After the cover 52 is glued in place, the outer surface of the cover 52 should be flush with the outer surface of the body 24.

The damping fluid may be any conventionally available high viscosity fluid such as the type of oil used in an automotive shock absorber.

The ball 44 may be formed of steel, lead or any other relatively dense material. Clearly the size and weight of the ball will vary depending on the racquet size and weight.

The body 24 and the cover 26 may be formed from any lightweight hard rubber or synthetic resin material. Preferably, the body 24 should be formed from black neoprene and the cover 26 should be formed from red neoprene. The difference in color is for aesthetic appeal and does not relate to the function of the device.

In use, the device 10 is installed between the two center main strings and the two cross strings nearest the throat of the racquet and is then rotated 90 degrees to the position shown in FIG. 1. In this position, the longest dimension of the device 10 extends parallel to the cross strings and the well 40 extends perpendicular to the plane of the racquet head so that the ball 44 can move perpendicular to the plane of the racquet head when the racquet strikes a ball. The dampened movement of the ball 44 in the high viscosity fluid 42 counteracts the force of a tennis ball or the like striking the strings of the racquet and thereby gives the racquet a more solid feel and reduces the vibrations of the racquet caused by this contact.

Figure 7:
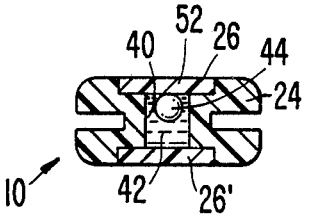
FIG. 7 is a side elevational view of a second embodiment of the vibration damping device of the present invention.

Various modifications may be made to the device 10 itself. For example, as shown in FIG. 7, the well 40 may be made to extend completely through the body 24. In this case, the ends of the well may be enclosed by covers 26 and 26' which are similar and are received in similar recesses formed in the body.

Clearly, numerous additional modifications and substitutions can be made in the present invention without departing from the scope of the invention as set forth in the appended claims.

What is claimed is:

1. A damping device for use with a striking implement having strings, comprising:

a shape sustaining body having a pair of end faces each having a greatest longitudinal dimension and a greatest lateral dimension, said body further having a peripheral wall extending between said end faces and defining a thickness of said body, said greatest longitudinal dimension being greater than said greatest lateral dimension so that said body has a generally oblong shape; and a peripheral groove formed in said peripheral wall such that the peripheral groove has a depth which is not uniform, the maximum depth of the peripheral groove being greater in said longitudinal dimension than said lateral dimension.

2. A damping device as set forth in claim 1, wherein said body has a central well having a top and a bottom, and further including:

means enclosing said top and said bottom;

a damping fluid received in said well; and a weight received in said damping fluid.

3. A damping device as set forth in claim 2, wherein said peripheral groove surrounds a square central portion of said body.

4. A damping device as set forth in claim 2, wherein said weight comprises a steel ball.

5. A damping device as set forth in claim 2, wherein said weight comprises a lead ball.

6. A damping device as set forth in claim 2, wherein said fluid is an oil.

7. In combination with a sports racquet having a plurality of crossing strings, a handle, a throat connected to said handle, and a bow connected to said throat and adapted for mounting said strings, a damping device, comprising:

a body having a pair of end faces each having a greatest longitudinal dimension and a greatest lateral dimension, said body further having a peripheral wall extending between said end faces and defining a thickness of said body, said greatest longitudinal dimension being greater than said greatest lateral dimension so that the body has a generally oblong shape, both said longitudinal dimension and said lateral dimension being greater than the distance between adjacent strings on said sports racquet, a peripheral groove dimensioned to receive the strings of said sports racquet, said peripheral groove being formed in said peripheral wall such that the peripheral groove has a maximum depth which is not uniform, the depth of the peripheral groove being greater in said longitudinal dimension than said lateral dimension, and further wherein said damping device is mounted in said strings such that said groove receives strings to entrap said damping device among said strings so that the body overlaps the strings to a greater extent in the longitudinal dimension of the body than in the lateral dimension.

8. A combination as set forth in claim 7, wherein said strings include at least one cross string positioned closest to said throat and two center main strings.

9. A combination as set forth in claim 8, wherein said longitudinal dimension is positioned parallel to said at least one cross string such that said body is elongated in a direction parallel to said at least one cross string.

10. A combination as set forth in claim 9, wherein said body is formed of a synthetic resin material.

11. A combination as set forth in claim 7, wherein said body includes a central well having a top and bottom, and said well extends in a direction which is perpendicular to the plane of the bow.

12. A combination as set forth in claim 11, including means enclosing the top and bottom of said well, wherein said means enclosing the top and bottom of said well comprise covers which are cemented to said body and form portions of said end faces.

13. A combination as set forth in claim 11, including means enclosing the top and bottom of said well, wherein said means enclosing the top and bottom of said well comprise a portion of said body and a cover cemented to said body.

14. A combination as set forth in claim 7 wherein said body has a central well having a top and a bottom; and further including:

means enclosing said top and said bottom;
a damping fluid received in said well; and
a weight received in said damping fluid.

* * * * *